US009579811B2

(12) United States Patent
Prince et al.

(10) Patent No.: US 9,579,811 B2
(45) Date of Patent: Feb. 28, 2017

(54) VARIABLE MOUNTING SYSTEM FOR A KNIFE SHEATH

(71) Applicant: Fiskars Brands, Inc., Madison, WI (US)

(72) Inventors: Jordan Prince, Wilsonville, OR (US); Benjamin J. Nyssen, Tigard, OR (US)

(73) Assignee: Fiskars Brands, Inc., Middleton, WI (US)

( * ) Notice: Subject to any disclaimer, the term of this patent is extended or adjusted under 35 U.S.C. 154(b) by 118 days.

(21) Appl. No.: 14/593,798

(22) Filed: Jan. 9, 2015

(65) Prior Publication Data

US 2015/0197023 A1 Jul. 16, 2015

Related U.S. Application Data

(60) Provisional application No. 61/925,906, filed on Jan. 10, 2014.

(51) Int. Cl.
*B26B 29/02* (2006.01)
*A45F 5/02* (2006.01)

(52) U.S. Cl.
CPC ..... *B26B 29/025* (2013.01); *A45F 5/021* (2013.01); *B26B 29/02* (2013.01); *A45F 2200/0575* (2013.01); *A45F 2200/0591* (2013.01)

(58) Field of Classification Search
CPC ..... B62B 29/02; B62B 29/025; A45F 5/021; A45F 2200/0575; A45F 2200/0591
USPC ..... 224/232
See application file for complete search history.

(56) References Cited

U.S. PATENT DOCUMENTS

| | | | | |
|---|---|---|---|---|
| 4,358,036 | A * | 11/1982 | Maltais | A45F 5/02 224/163 |
| 4,746,042 | A | 5/1988 | King | |
| 5,511,706 | A | 4/1996 | Hendrickson | |
| 6,325,577 | B1 | 12/2001 | Anderson | |
| 7,007,352 | B1 | 3/2006 | Hill | |
| 7,331,872 | B1 | 2/2008 | Parsons | |
| 2008/0104802 | A1 | 5/2008 | Vermillion | |
| 2009/0307878 | A1 | 12/2009 | Kadas | |
| 2012/0152997 | A1 | 6/2012 | McClain | |
| 2013/0047386 | A1 | 2/2013 | Barfoot et al. | |

FOREIGN PATENT DOCUMENTS

JP 2003-311660 11/2003

OTHER PUBLICATIONS

International Search Report and Written Opinion for International Application PCT/US2015/010897, mail date Apr. 22, 2015, 10 pages.
International Preliminary Report on Patentability, PCT/US2015/010897, Fiskars Brands, Inc. 8 pages. (Jul. 21, 2016).

* cited by examiner

*Primary Examiner* — Corey Skurdal
(74) *Attorney, Agent, or Firm* — Foley & Lardner LLP

(57) ABSTRACT

A belt mounting system includes a main body, a device coupled to the main body, a belt mount configured to be coupled to a belt, and a locking element, wherein the main body and the belt mount are coupled to one another by the locking element.

18 Claims, 5 Drawing Sheets

VARIABLE MOUNTING SYSTEM FOR A KNIFE SHEATH

CROSS-REFERENCE TO RELATED PATENT APPLICATIONS

This application claims the benefit of U.S. Application No. 61/925,906, filed Jan. 10, 2014, which is incorporated herein by reference in its entirety.

BACKGROUND

On traditional sheathes, such as for a knife, gun, or other tool, there is often only one mounting option for user to attach the sheath to a piece of gear or clothing. For example, the sheath may have a belt loop that allows for a belt mount, or the sheath may have a strip secured by a snap or a locking clip that allows for mounting to a webbing system, such as on modular lightweight load-carrying equipment (MOLLE) and compatible gear.

SUMMARY

One embodiment of the invention relates to a belt mounting system including a main body, a knife sheath coupled to the main body, a knife configured to be stored in the knife sheath, a belt, a belt mount configured to be coupled to the belt, and a locking element, wherein the locking element includes a pair of flexible arms, each including a locking tab, wherein when the main body and the belt mount are positioned adjacent one another, the main body and the belt mount cooperate to form a slide track and the locking element is inserted into the slide track to couple the main body and the belt mount to one another, wherein the locking tabs secure the locking element within the slide track when the flexible arms are in an extended position, and wherein the locking element may be inserted into or removed from the slide track when the flexible arms are in a deflected position.

Another embodiment of the invention relates to a belt mounting system including a main body, a device coupled to the main body, wherein the device is at least one of a sheath, a pouch, a pocket, and a holster, a belt, a belt mount configured to be coupled to the belt, and a locking element, wherein the locking element includes a pair of flexible arms, each including a locking tab, wherein when the main body and the belt mount are positioned adjacent one another, the main body and the belt mount cooperate to form a slide track and the locking element is inserted into the slide track to couple the main body and the belt mount to one another, wherein the locking tabs secure the locking element within the slide track when the flexible arms are in an extended position, and wherein the locking element may be inserted into or removed from the slide track when the flexible arms are in a deflected position.

Another embodiment of the invention relates to a belt mounting system including a main body, a device coupled to the main body, a belt mount configured to be coupled to a belt, and a locking element, wherein the main body and the belt mount are coupled to one another by the locking element.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
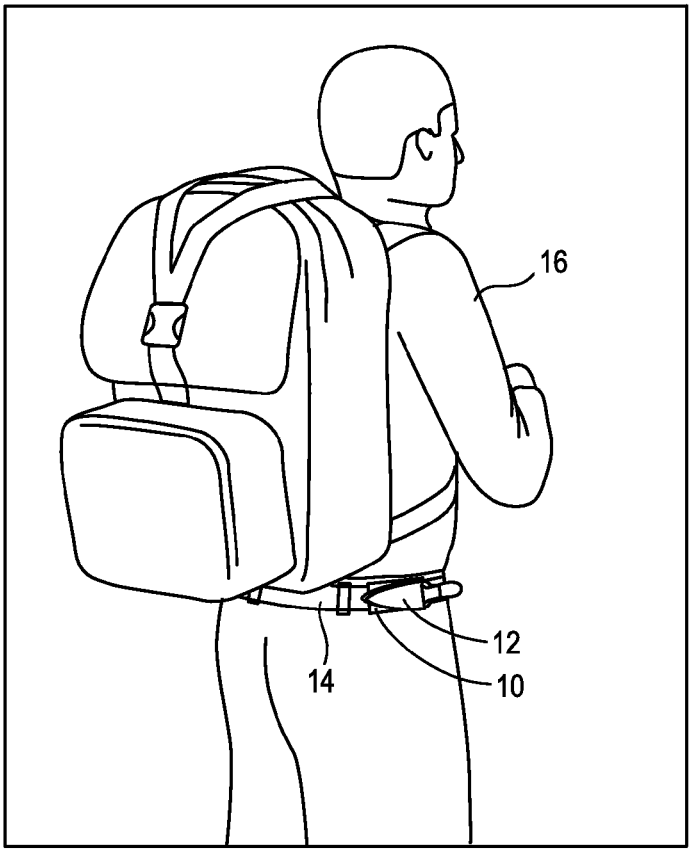
FIG. 1 is a schematic view of a knife mounted to the belt of a user with a mounting system.
Figure 9:
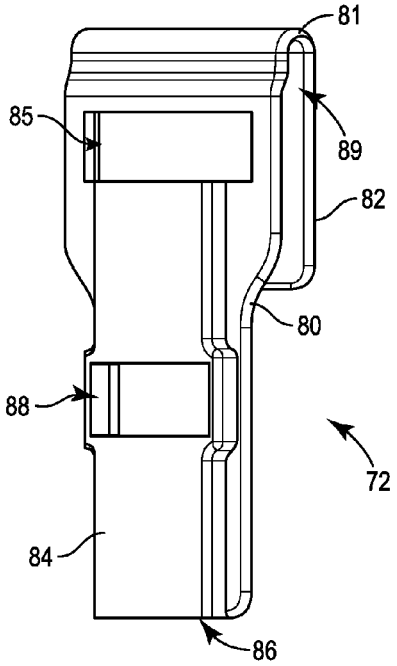
FIG. 9 is front perspective view of a belt mount for the belt mounting system of FIG. 8, according to an exemplary embodiment.
Figure 10:
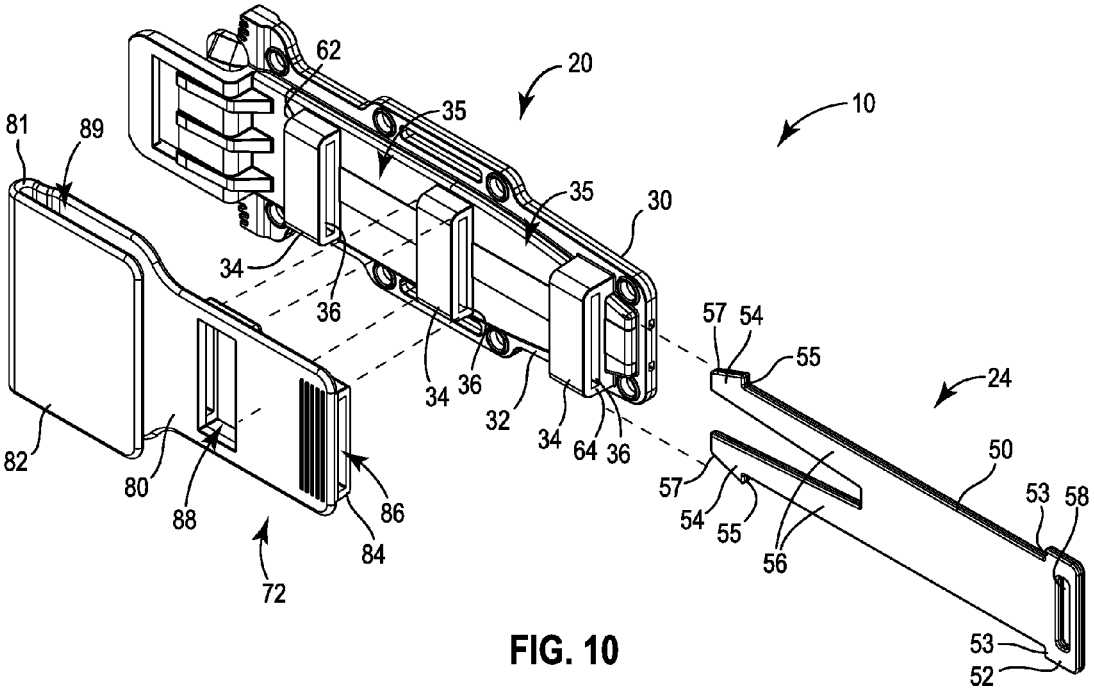
FIG. 10 is an exploded perspective view of the mounting system of FIG. 8.
Figure 11:
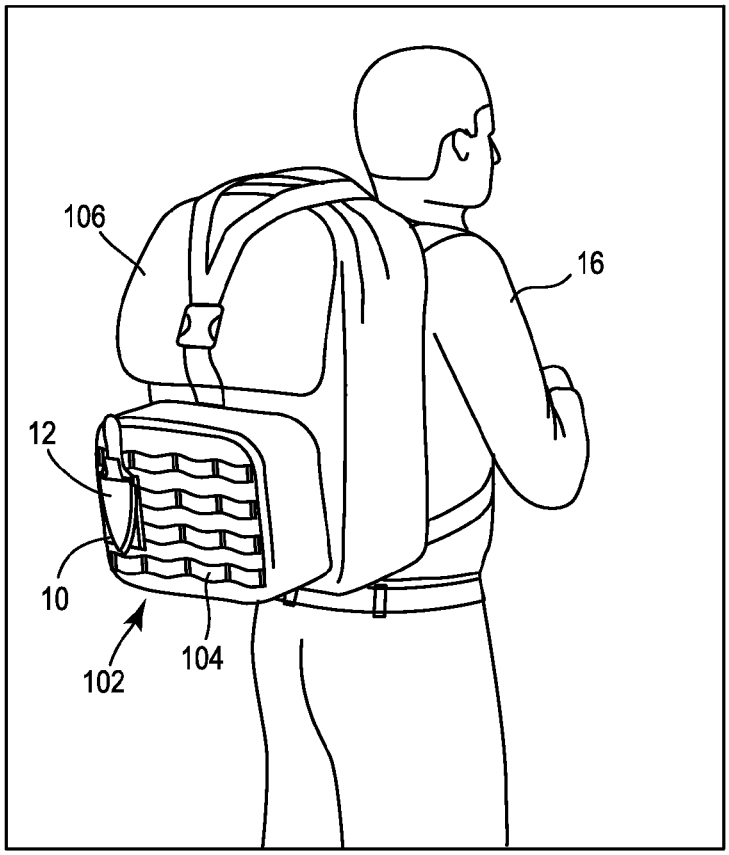
FIG. 11 is a schematic view of a knife mounted to a webbing system with a mounting system.

Referring in general to FIGS. 1-12, a mounting system 10 is shown according to various embodiments to mount a device, shown in general as a knife sheath 12, to a piece of clothing or equipment, shown in FIG. 1 as a belt 14 worn by a user 16. In various embodiments, the mounting system 10 may be utilized to mount a knife sheath 12 such that the belt 14 is threaded through the mounting system 10 or such that the mounting system 10 hangs from the belt 14. The mounting system 10 is configured such that it may also be utilized to mount a knife sheath 12 or another device to a webbing system 102, as shown in FIG. 11. In other embodiments, the mounting system 10 may be configured to mount another device, such as a holster for a gun, a holster for a tool (e.g., an axe), a pocket or pouch for a radio, a magazine, a cell phone or other mobile device, etc.

Figure 2:
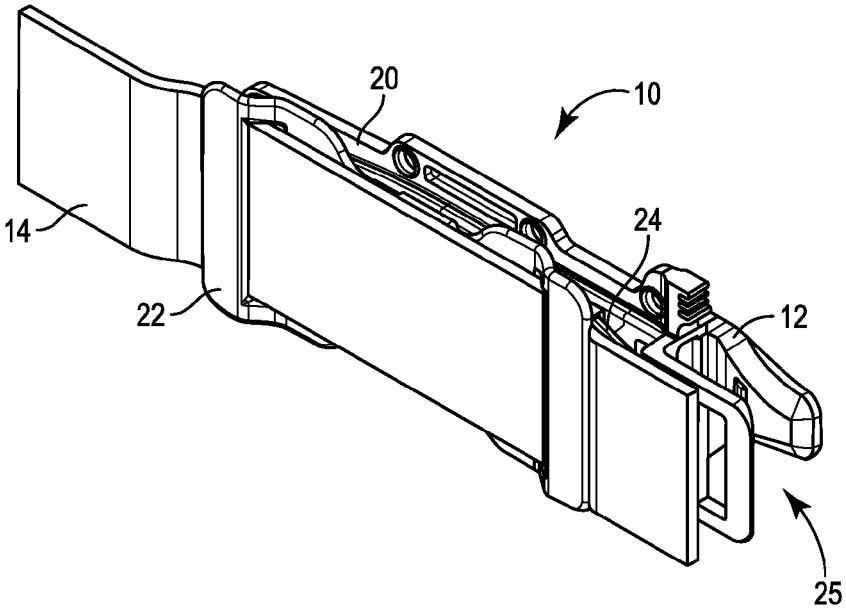
FIG. 2 is a rear perspective view of a mounting system coupled to a belt, according to an exemplary embodiment.
Figure 3:
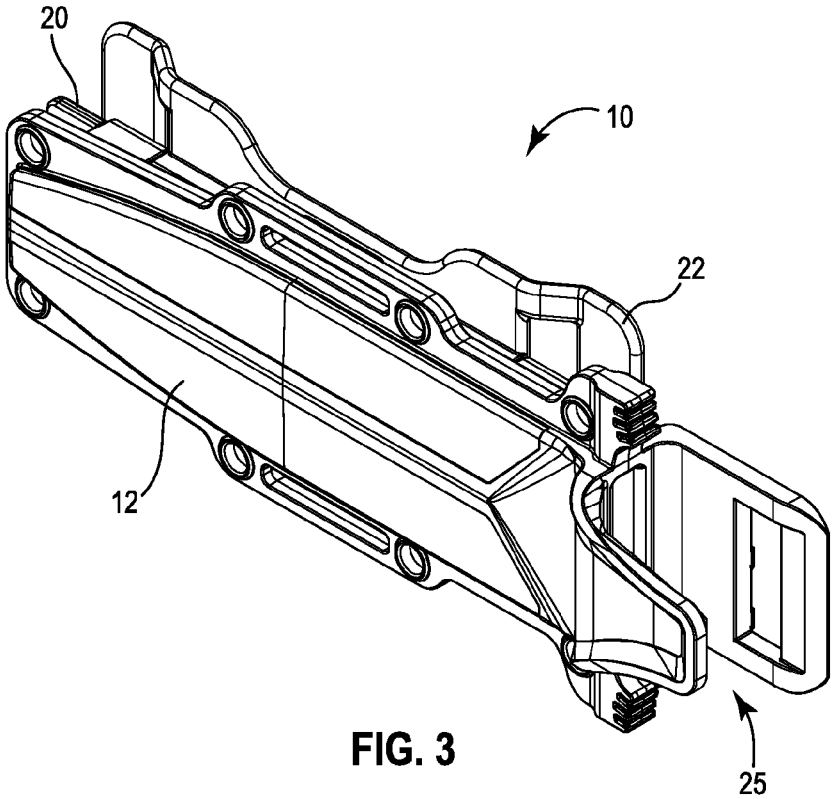
FIG. 3 is a front perspective view of the mounting system of FIG. 2.
Figure 4:
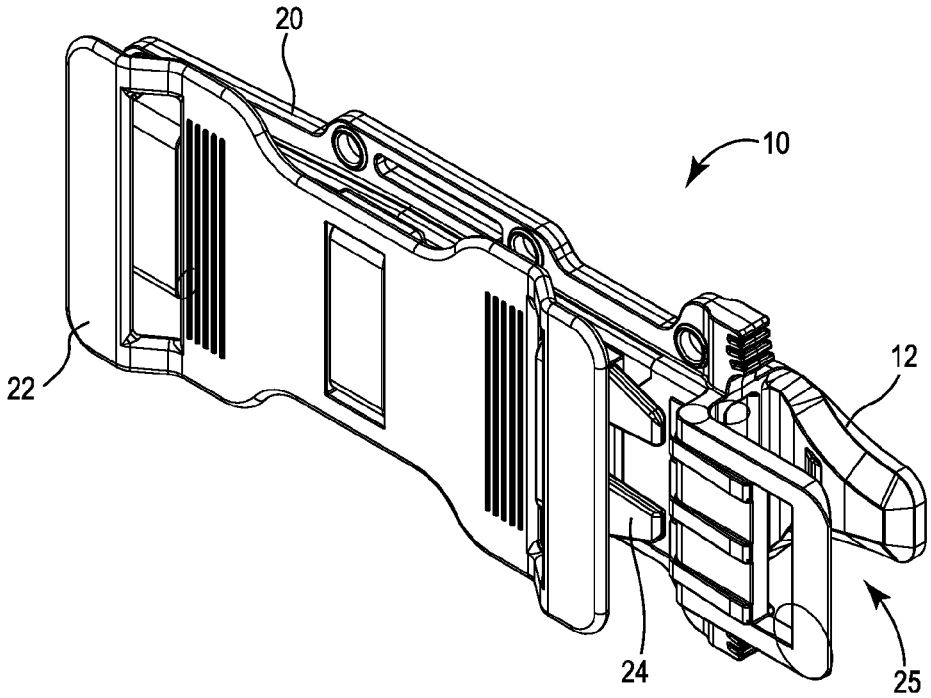
FIG. 4 is a rear perspective view of the mounting system of FIG. 2.

Referring to FIGS. 2-4, the mounting system 10 is shown according to one exemplary embodiment to mount the knife sheath 12 parallel to the belt 14. The mounting system 10 includes a main body 20 that is coupled to the knife sheath 12, a belt mount 22 that is slidably coupled to the belt 14, and locking element, shown as a slider 24, that couples the belt mount 22 to the main body 20. In one embodiment, the knife sheath 12 may be a sheath for a fixed-blade knife. The knife sheath 12 includes a cavity 25 that receives a knife blade while the knife handle extends out of the knife sheath 12. In another embodiment, the knife sheath 12 may be a sheath for a folding blade knife and the knife sheath 12 may contain both the knife blade and the knife handle.

Figure 5:
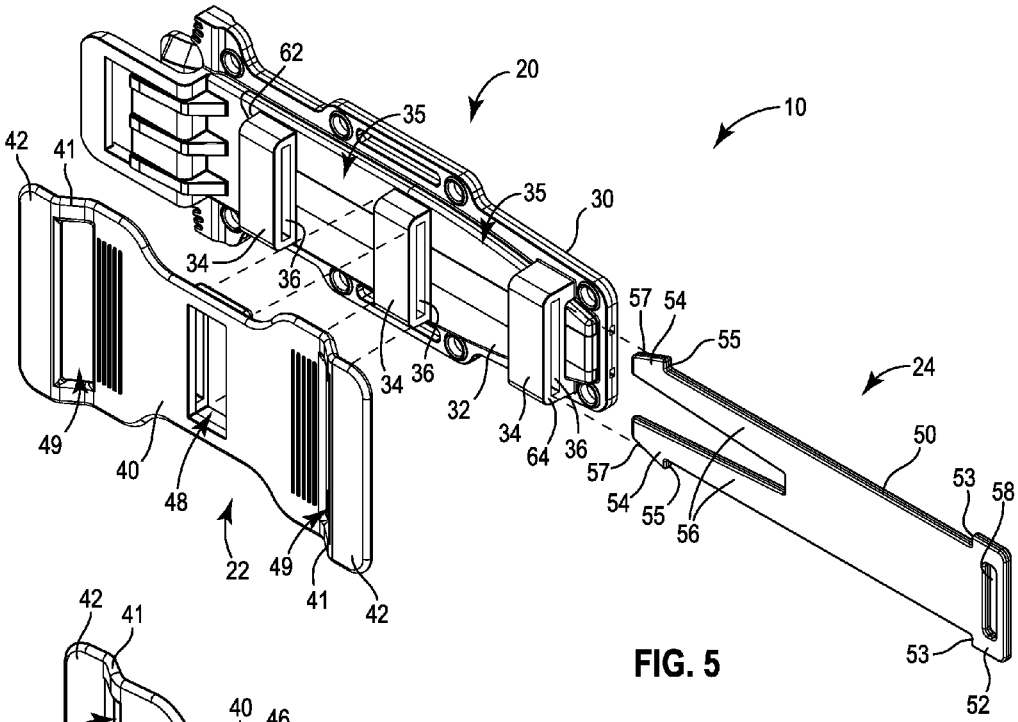
FIG. 5 is an exploded perspective view of the mounting system of FIG. 2.

Referring to FIG. 5, an exploded view of the mounting system 10 is shown. The knife sheath 12 (shown in FIG. 3)

or other device to be mounted is positioned on a front side 30 of the main body 20. In one embodiment, the main body 20 may be integrally formed with the knife sheath 12 (e.g., as a single injection molded component). In other embodiments, the main body 20 may be a separate body from the knife sheath 12 that is permanently or removably coupled to the knife sheath 12. The main body 20 may be permanently coupled to the knife sheath 12, for example, with rivets, threaded fasteners, an adhesive, a weld, or any other suitable permanent fastening mechanism. In other embodiments, the main body 20 may be removably coupled to the knife sheath 12, for example, with a snap, clip, or any other mechanism that allows the user 18 to easily decouple the knife sheath 12 from the main body 20.

The main body 20 includes multiple protrusions 34 (e.g., bosses, blocks, extensions, etc.) extending from the back side 32, opposite the knife sheath 12. According to an exemplary embodiment, the main body 20 includes three protrusions 34, separated by spaces 35. The protrusions 34 define slots 36 that are sized to receive the slider 24. The slots 36 are oriented and aligned such that the slider 24 may pass through the slots 36 to engage multiple protrusions 34.

Figure 6:
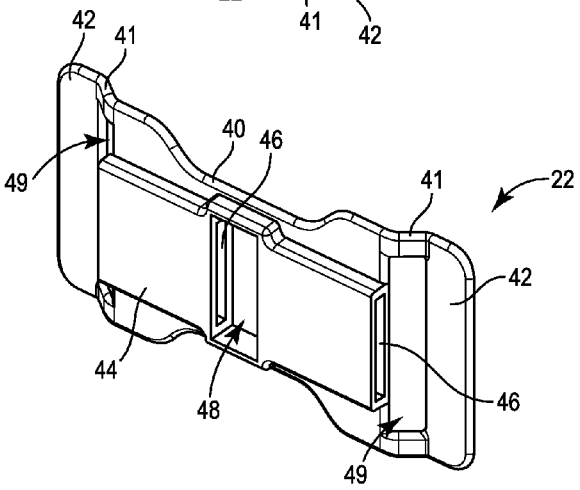
FIG. 6 is a front perspective view of a belt mount for the mounting system of FIG. 2, according to an exemplary embodiment.

Referring to FIG. 6, the belt mount 22 is shown. The belt mount 22 is configured to be coupled to the main body 20 and provides a structure to couple the main body 20 to the belt 14 or piece of webbing such that the belt 14 is threaded through the main body 20 (see FIG. 2). The belt mount 22 includes a center portion 40 and a pair of end portions 42 that are offset (e.g., raised, elevated, extended, outthrust, etc.) from the center portion 40 in a direction away from main body 20 when the belt mount 22 is coupled to the main body 20. The end portions 42 are connected to the center portion 40 by slanted transitional portions 41. The belt mount 22 includes a protrusion 44 (e.g., boss, block, extension, etc.) extending from the center portion 40 in a direction opposite the end portions 42. The protrusion 44 defines a slot 46 that is sized to receive the slider 24. The protrusion 44 further defines a central opening 48 that is sized to receive the middle protrusion 34 of the main body 20. The transitional portions 41 define end openings 49 that are configured to receive at least one thickness of the belt 14 or webbing to which the belt mount 22 is mounted. Alternatively, the mounting structures of the main body 20 (i.e., the protrusions 34 and the spaces 35) and the mounting structures of the belt mount 22 (i.e., the protrusion 44 and the central opening 48) may be switched so that mounting structures like those of the belt mount 22 are found on the main body and vice versa.

Referring back to FIG. 5, the slider 24 is an elongated structure that is configured to engage both the main body 20 and the belt mount 22 to couple the main body 20 to the belt mount 22. According to an exemplary embodiment, the slider 24 includes a body 50, a head 52 on one end of the body 50, and a pair of locking tabs 54 (e.g., barbs, catches, etc.) opposite the head 52. The locking tabs 54 are provided on the ends of flexible arms 56. The flexible arms 56 form cantilever springs that allow the locking tabs 54 to be defected inward toward one another. The body 50 has a width that is less than or equal to the width of the slots 36 and 46. The head 52 has a width that is greater than the width of the slots 36 and 46. The tabs 54 extend to a width that is greater than the width of the slots 36 and 46 and can deflect inward via the flexible arms 56 to a width less than the width of the slots 36 and 46. According to an exemplary embodiment, the head 52 includes a slot 58 that facilitates the grasping of the head 52 or the engagement of the head 52 by a tool, such as a flat-head screwdriver.

Figure 7:
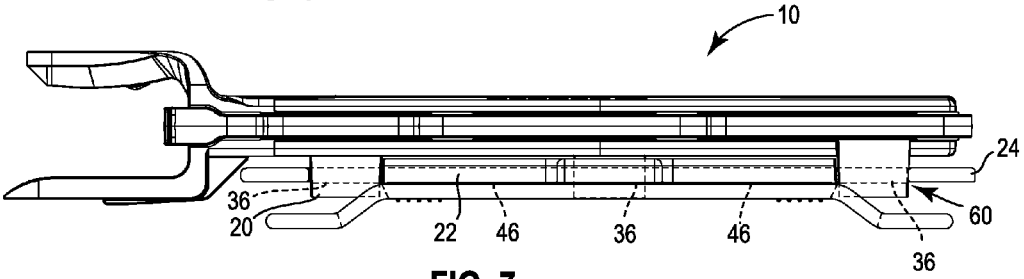
FIG. 7 is a top view of the mounting system of FIG. 2

Referring to FIG. 7, the main body 20 is shown coupled to the belt mount 22. The protrusion 44 is sized to fit between the outer protrusions 34 of the main body 20 when the middle protrusion 34 is received in the central opening 48. When the belt mount 22 is in position relative to the main body 20, the slots 46 are aligned with the slots 36 to form a continuous slide track 60 that receives the slider 24. The slider 24 is inserted into the slide track 60 locking tab-side first. Slanted surfaces 57 of the locking tabs 54 contact the protrusion 34, forcing the arms 56 to flex inward until the locking tabs 54 can enter the slide track 60. The slider 24 is advanced into the slide track 60 until the locking tabs 54 emerge from the opposite end of the slide track 60. The arms 56 bias the locking tabs 54 outward. With the slider 24 fully seated in the slide track 60, the belt mount 22 is fixed to the main body 20 through the interconnection of the main body 20, the belt mount 22, and the slider 24. The lateral movement of the slider 24 is prevented by contact between contact surfaces 55 of the locking tabs 54 and a contact surface 62 of one of the protrusions 34 and by the contact between contact surfaces 53 of the head 52 and a contact surface 64 of the opposite protrusion 34.

The slider 24 may be removed from the slide track 60 by deflecting (e.g., squeezing, compressing, pinching, etc.) the locking tabs 54 inward until they can be moved into the slot 36 to disengage the protrusion 34. The head 52 of the slider 24 can be grasped to allow the user 16 to pull the slider 24 out of the slide track 60.

Figure 8:
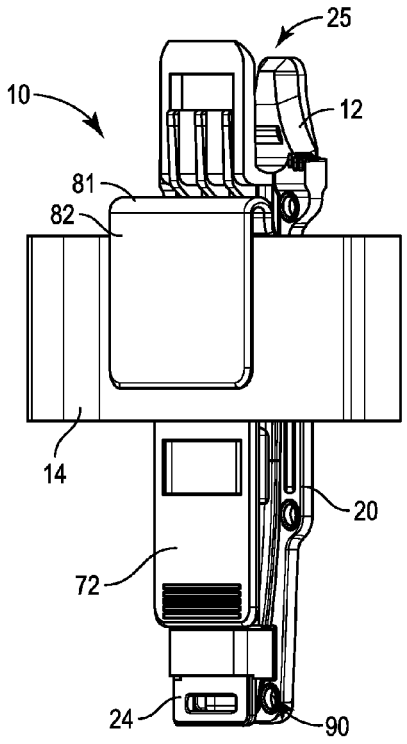
FIG. 8 is a rear perspective view of a mounting system coupled to a belt, according to another exemplary embodiment.

Referring now to FIGS. 8-10, the mounting system 10 is shown according to another exemplary embodiment to mount the knife sheath 12 such that it hangs vertically from the belt 14. The mounting system 10 includes the main body 20 that is coupled to the knife sheath 12, a belt mount 72 that hangs from the belt 14, and the slider 24 that couples the belt mount 72 to the main body 20.

Referring to FIG. 9, the belt mount 72 is shown. The belt mount 72 is configured to be coupled to the main body 20 and provides a structure to couple the main body 20 to the belt 14 or piece of webbing such that the main body 20 hangs vertically from the belt 14 or piece of webbing. The belt mount 72 includes a base portion 80 and hook portion 82 that is generally parallel to and offset from the base portion 80 in a direction away from main body 20 when the belt mount 72 is coupled to the main body 20. The hook portion 82 is connected to the base portion 80 by a curved connecting portion 81. The belt mount 72 includes a protrusion 84 (e.g., boss, block, extension, etc.) extending from the base portion 80 in a direction opposite the hook portion 82. The protrusion 84 defines a slot 86 that is sized to receive the slider 24. The protrusion 84 further defines a central opening 88 that is sized to receive the middle protrusion 34 of the main body 20. A second opening 85 is defined in the base portion 80 that is sized to receive an outer protrusion 34 of the main body 20. The hook portion 82 is separated from the base portion 80 by a space defining a slot 89.

Referring to FIG. 10, the main body 20 is shown coupled to the belt mount 72. The belt mount 72 is configured to be coupled to the main body 20 in a manner similar to the belt mount 22 described above. The protrusion 84 is sized to fit between the outer protrusions 34 of the main body 20 when the middle protrusion 34 is received in the central opening 88. One of the outer protrusions 34 is received in the opening 85 in the base portion 80. The slots 86 are aligned with the slots 36 to form a continuous slide track 90 (see FIG. 8) that receives the slider 24. The slider 24 is inserted into the slide track 90 locking tab-side first. Slanted surfaces 57 of the locking tabs 54 contact the protrusion 34, forcing the arms 56 to flex inward until the locking tabs 54 can enter the slide track 90. The slider 24 is advanced into the slide track 90 until the locking tabs 54 emerge from the opposite end of the slide track 90. The arms 56 bias the locking tabs 54 outward. With the slider 24 fully seated in the slide track 90, the belt mount 72 is fixed to the main body 20 through the interconnection of the main body 20, the belt mount 72, and the slider 24. The lateral movement of the slider 24 is prevented by contact between contact surfaces 55 of the locking tabs 54 and a contact surface 62 of one of the protrusions 34 and by the contact between contact surfaces 53 of the head 52 and a contact surface 64 the opposite protrusion 34.

Referring back to FIG. 8, the mounting system 70 is shown coupled to the belt 14. The mounting system 10 is hooked onto the belt 14 by sliding the hook portion 82 onto the belt 14. The slot 89 is configured to receive at least one thickness of the belt 14 or webbing to which the knife sheath 12 is mounted. The connecting portion 81 may be configured to flex, allowing the hook portion 82 to move away from the base portion 80. In some embodiments, the slot 89 may be narrower than the thickness of the belt 14 or webbing to which the knife sheath 12 is mounted such that the hook portion 82 is biased outward and applies a pressure on the belt 14 or webbing to more securely mount the knife sheath 12 via the mounting system 70.

Figure 12:
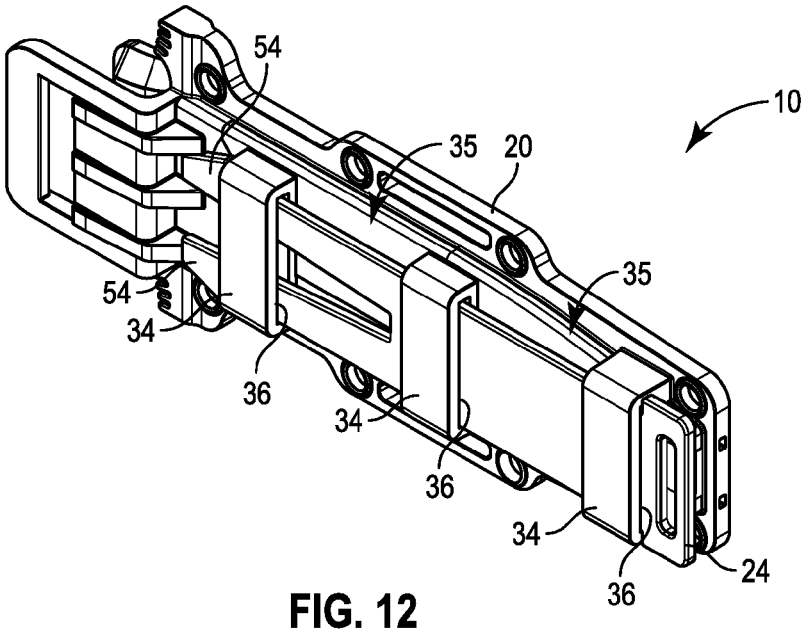
FIG. 12 is a rear perspective view of a mounting system, according to another exemplary embodiment.

Referring now to FIGS. 11-12, the mounting system 10 is shown according to another exemplary embodiment. The mounting system 10 is configured to couple a knife sheath 12 or another device to a webbing system 102 supported by a piece of clothing or equipment, such as Pouch Attachment Ladder System (PALS) webbing, which is utilized on some military gear (e.g., MOLLE rucksacks, tactical vests, etc.) as well as on commercial clothing and backpacks. The webbing system 102 includes parallel rows of webbing 104 that are attached to the piece of clothing or equipment at regular intervals, forming a series of webbing loops. As shown in FIG. 11, in one embodiment, the webbing system 102 is provided on a backpack 106.

Referring to FIG. 12, the mounting system 10 includes the main body 20 and the slider 24, described above, without the belt mount 22 or the belt mount 72. The mounting system 10 is positioned such that the webbing 104 of the webbing system 102 is received in the spaces 35 between the protrusions 34 of the main body 20. The slider 24 is inserted into the slide track formed by the slots 36 and between the webbing 104 and the backpack 106, trapping the webbing 104 between the slider 24 and the main body 20. The slider 24 is then locked into place with the locking tabs 54 to secure the mounting system 10 to the webbing system 102. In other embodiments, the mounting system 100 may be utilized to mount the knife sheath to any piece of equipment with the standardized webbing system 102, such as vests, duffel bags, hydration packs, pouches, gun bags, etc.

By using a common main body 20 and locking slider 24, a user may mount the sheath 12 or other device to the belt 14, a single piece of webbing, or the webbing system 102 either horizontally with belt mount 22 or vertically with belt mount 72 for mounting or by foregoing either of the belt mounts for mounting directly to the webbing system 102. While the mounting system 10 is described as being used to mount a knife sheath 12, in other embodiments, the mounting system 10 may be used to mount a wide variety of devices (e.g., a gun holster, ammunition pouch, gear pouch, etc.) to either a belt, a single piece of webbing, or a webbing system, depending on the needs of the user. In embodiments where the sheath 12 is removably coupled to the main body 20, the user can also change the type of device (e.g., sheath, holster, pouch, pocket, etc. for various tools or gear) coupled to the main body 20.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

The construction and arrangement of the elements of the mounting system as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures. This should not be construed as an implication that these components are identical in all embodiments; various modifications may be made in various different embodiments. It should be noted that the elements and/or assemblies of the enclosure may be constructed from any of a wide variety of materials that provide sufficient strength or durability, in any of a wide variety of colors, textures, and combinations. Furthermore, other substitutions, modifications, changes, and omissions may be made in the design, operating conditions, and arrangements of the exemplary embodiments without departing from the scope of the invention as expressed in the appended claims.

What is claimed is:

1. A belt mounting system comprising:
a main body;
a knife sheath coupled to the main body;
a knife configured to be stored in the knife sheath;
a belt;
a belt mount configured to be coupled to the belt; and
a locking element, wherein the locking element includes a pair of flexible arms, each including a locking tab;
wherein when the main body and the belt mount are positioned adjacent one another, the main body and the belt mount cooperate to form a slide track and the locking element is inserted into the slide track to couple the main body and the belt mount to one another;
wherein the locking tabs secure the locking element within the slide track when the flexible arms are in an extended position; and
wherein the locking element may be inserted into or removed from the slide track when the flexible arms are in a deflected position.

2. The belt mounting system of claim 1, wherein the main body is arranged horizontally along the belt.

3. The belt mounting system of claim 1, wherein the main body is arranged vertically relative to the belt.

4. The belt mounting system of claim 1, wherein the main body includes a plurality of protrusions extending from the side of the main body opposite the knife sheath, wherein each protrusion defines a slot that forms a portion of the slide track, and wherein each of the protrusions is separated from the adjacent protrusion by a space.

5. The belt mounting system of claim 4, wherein the belt mount includes a protrusion that defines a slot that forms a portion of the slide track and that defines a central opening sized to receive one of the protrusions of the main body when the main body and the belt mount cooperate to form the slide track.

6. The belt mounting system of claim 4, further comprising:

a webbing system including a plurality of webbings, wherein when the main body and the webbing system are positioned adjacent one another, the spaces between the protrusions of the main body each receive a webbing and the locking element is inserted through the slots in the protrusions and the webbings to couple the main body to the webbing system.

7. A belt mounting system comprising:

a main body;

a device coupled to the main body, wherein the device is at least one of a sheath, a pouch, a pocket, and a holster;

a belt;

a belt mount configured to be coupled to the belt; and a locking element, wherein the locking element includes a pair of flexible arms, each including a locking tab;

wherein when the main body and the belt mount are positioned adjacent one another, the main body and the belt mount cooperate to form a slide track and the locking element is inserted into the slide track to couple the main body and the belt mount to one another;

wherein the locking tabs secure the locking element within the slide track when the flexible arms are in an extended position; and wherein the locking element may be inserted into or removed from the slide track when the flexible arms are in a deflected position.

8. The belt mounting system of claim 7, wherein the main body includes a plurality of protrusions extending from the side of the main body opposite the device, wherein each protrusion defines a slot that forms a portion of the slide track, and wherein each of the protrusions is separated from the adjacent protrusion by a space.

9. The belt mounting system of claim 8, wherein the belt mount includes a protrusion that defines a slot that forms a portion of the slide track and that defines a central opening sized to receive one of the protrusions of the main body when the main body and the belt mount cooperate to form the slide track.

10. The belt mounting system of claim 8, further comprising:

a webbing system including a plurality of webbings, wherein when the main body and the webbing system are positioned adjacent one another, the spaces between the protrusions of the main body each receive a webbing and the locking element is inserted through the slots in the protrusions and the webbings to couple the main body to the webbing system.

11. A belt mounting system comprising:

a main body;

a device coupled to the main body;

a belt mount configured to be coupled to a belt; and a locking element, wherein the main body and the belt mount are coupled to one another by the locking element;

wherein when the main body and the belt mount are positioned adjacent one another, the main body and the belt mount cooperate to form a slide track and the locking element is inserted into the slide track to couple the main body and the belt mount to one another; and wherein the main body includes a plurality of protrusions extending from the side of the main body opposite the device, wherein each protrusion defines a slot that forms a portion of the slide track, and wherein each of the protrusions is separated from the adjacent protrusion by a space.

12. The belt mounting system of claim 11, wherein the device is at least one of a sheath, a pouch, a pocket, and a holster.

13. The belt mounting system of claim 11, further comprising a belt coupled to the belt mount.

14. The belt mounting system of claim 13, wherein the main body is arranged horizontally along the belt.

15. The belt mounting system of claim 13, wherein the main body is arranged vertically relative to the belt.

16. The belt mounting system of claim 11, wherein the locking element includes a pair of flexible arms, each including a locking tab, for securing the locking element within the slide track when the flexible arms are in an extended position and for allowing the locking element to be inserted into or removed from the slide track when the flexible arms are in a deflected position.

17. The belt mounting system of claim 11, wherein the belt mount includes a protrusion that defines a slot that forms a portion of the slide track and that defines a central opening sized to receive one of the protrusions of the main body when the main body and the belt mount cooperate to form the slide track.

18. The belt mounting system of claim 11, further comprising:

a webbing system including a plurality of webbings, wherein when the main body and the webbing system are positioned adjacent one another, the spaces between the protrusions of the main body each receive a webbing and the locking element is inserted through the slots in the protrusions and the webbings to couple the main body to the webbing system.

* * * * *